US007357761B2

(12) United States Patent
Mattox

(10) Patent No.: US 7,357,761 B2
(45) Date of Patent: Apr. 15, 2008

(54) UNIVERSAL EXERCISE ARTICLE

(76) Inventor: E. Michael Mattox, 615 Waukazoo Ave., Petoskey, MI (US) 49770

( * ) Notice: Subject to any disclaimer, the term of this patent is extended or adjusted under 35 U.S.C. 154(b) by 658 days.

(21) Appl. No.: 10/476,072

(22) PCT Filed: Apr. 30, 2002

(86) PCT No.: PCT/US02/13600

§ 371 (c)(1),
(2), (4) Date: Oct. 23, 2003

(87) PCT Pub. No.: WO02/087703

PCT Pub. Date: Nov. 7, 2002

(65) Prior Publication Data

US 2004/0147380 A1 Jul. 29, 2004

Related U.S. Application Data

(60) Provisional application No. 60/287,869, filed on May 1, 2001.

(51) Int. Cl.
*A63B 21/02* (2006.01)
*A63B 23/02* (2006.01)

(52) U.S. Cl. ..... 482/125; 482/126; 482/129; 482/130; 482/140; 482/141; 482/907

(58) Field of Classification Search ..... 482/121–126, 482/129–132, 92, 140, 141, 148, 907, 38, 482/41, 42
See application file for complete search history.

(56) References Cited

U.S. PATENT DOCUMENTS 3,540,724 A * 11/1970 Hunter ..... 482/142
4,241,914 A * 12/1980 Bushnell ..... 482/130
4,638,995 A * 1/1987 Wilson ..... 482/142
5,514,058 A * 5/1996 Buoni et al. ..... 482/124
5,547,446 A * 8/1996 Szabo ..... 482/121
5,630,778 A 5/1997 Barreca
5,720,700 A * 2/1998 Buoni et al. ..... 482/124
5,741,207 A * 4/1998 Buoni et al. ..... 482/124
5,776,042 A 7/1998 Szabo
5,911,652 A * 6/1999 Jackson ..... 482/121
6,024,679 A * 2/2000 Castallanos et al. ..... 482/140
6,196,949 B1 3/2001 Rodarte
6,203,473 B1 * 3/2001 Atwood ..... 482/95
6,220,995 B1 * 4/2001 Chen ..... 482/140
6,692,417 B2 * 2/2004 Burrell ..... 482/142
7,232,405 B2 * 6/2007 Ko ..... 482/146

* cited by examiner

*Primary Examiner*—Jerome Donnelly
*Assistant Examiner*—Victor K. Hwang
(74) *Attorney, Agent, or Firm*—McGarry Bair PC

(57) ABSTRACT

A universal exercise device comprising a U-shape rigid frame with legs upper portions lying generally in a plane, a bight portion joining the legs at lower portions thereof and handles at an upper portion of the legs. At least one resilient resistance member spans the legs and to yieldably resist elongation when pressed while otherwise holding the frame against the elongation of the resilient resistance member. The lower portions of the legs can be bent outwardly to form generally L-shaped legs with the bight portion lying outside the plane of the upper leg portions or can lie within the plane of the upper leg portions. The legs can be joined together at an upper portion with a crosspiece or free at the upper portions thereof. The crosspiece can be U-shaped and project out of the plane of the legs either forwardly or rearwardly with respect to the bight portion.

46 Claims, 18 Drawing Sheets

UNIVERSAL EXERCISE ARTICLE

RELATED APPLICATION

This application claims priority of U.S. Provisional Application No. 60/287,869, filed May 1, 2001.

BACKGROUND OF THE INVENTION

1. Technical Field

This invention relates to exercise devices. In one aspect, the invention relates to a portable exercise article to facilitate the performance of a variety of different exercises.

2. Description of Related Art

Physical exercise is recognized as important to the maintenance of good health and well-being. Physical exercise equipment that can facilitate and even enhance physical exercise can take many forms. Some devices are relatively complex machines that enable the performance of a variety of exercises at various "stations" around the apparatus. Such devices tend to be large and expensive. Because of their size, they are not easily stored. Thus, they are typically used in gyms and home exercise rooms, the latter requiring a special room dedicated to the exercise apparatus. Other devices, such as free weights, are relatively simple. However, they are heavy, and a large number of components must generally be available for a complete physical workout, including the weights themselves and benches. Depending on the number of components, a special exercise room may be needed for use and storage. Other devices, while simple and relatively lightweight, may be limited to an exercise for strengthening only a single part of the body. Thus, there is the need for a simple, lightweight, portable universal exercise article that enables a user to perform multiple exercises for strengthening all the muscles of the body.

SUMMARY OF INVENTION

According to the invention, a universal exercise device comprises a rigid frame of a size to be gripped by a user and used for multiple exercises. The rigid frame is formed generally of a U-shape with parallel legs of the U-shape having upper portions thereof lying generally in a relatively flat plane. A bight portion of the U-shaped frame joins the legs at lower portions thereof and handles are formed at an upper portion of the legs for gripping by a user. At least one resilient resistance member spans the legs and is of sufficient strength to yieldably resist deformation with respect to the legs when pressed by a user of the device while otherwise holding the frame against the elongation of the resilient resistance member. The lower portions of the legs can be bent outwardly of the plane of the upper portion of the legs to form generally L-shaped legs with the bight section outward of the plane of the upper portions of the legs. The legs can be bent through a relatively wide arc to form a rocker portion of the legs for rocking motion of the frame by a user. Alternatively, the lower portions of the legs can lie within the plane of the legs upper portions so that the frame is relatively flat.

The legs can be joined together at an upper portion with a crosspiece or free at the upper portions thereof. The crosspiece can be U-shaped and project out of the plane of the legs either forwardly or rearwardly with respect to the bight portion of the legs. The frame can be padded with tubular cushions for comfort of the user.

In one embodiment, the legs of the frame are formed of inner and outer telescoping tubes for adjustment of the length of the legs to accommodate users of different heights or for different exercises. The entire frame can be formed of a lightweight tubular material such as steel or aluminum alloys. A selective locking mechanism can be mounted between the inner and outer telescoping tubes for selectively locking the tubes in selected adjustable positions. In one embodiment, the locking mechanism comprises a pin resiliently mounted within the inner tube and projecting through an aperture in the inner tube, and multiple aligned pin receiving apertures in the outer tube. In a preferred embodiment of the invention, a U-shaped spring is mounted within the inner tube and forms the resilient mounting of the pin within the inner tube.

The resilient resistant member is preferably formed of an elastic band. In addition, a tubular cushion preferably encircles the band between the legs of the frame. Further, more than one resilient resistant member is mounted to the frame. In a preferred embodiment, three resilient resistant members are mounted to the frame between the legs thereof. The resilient resistant members are slidably mounted to the frame for movement along the legs thereof for performance of different exercises.

DETAILED DESCRIPTION OF THE EMBODIMENT

Figure 1:
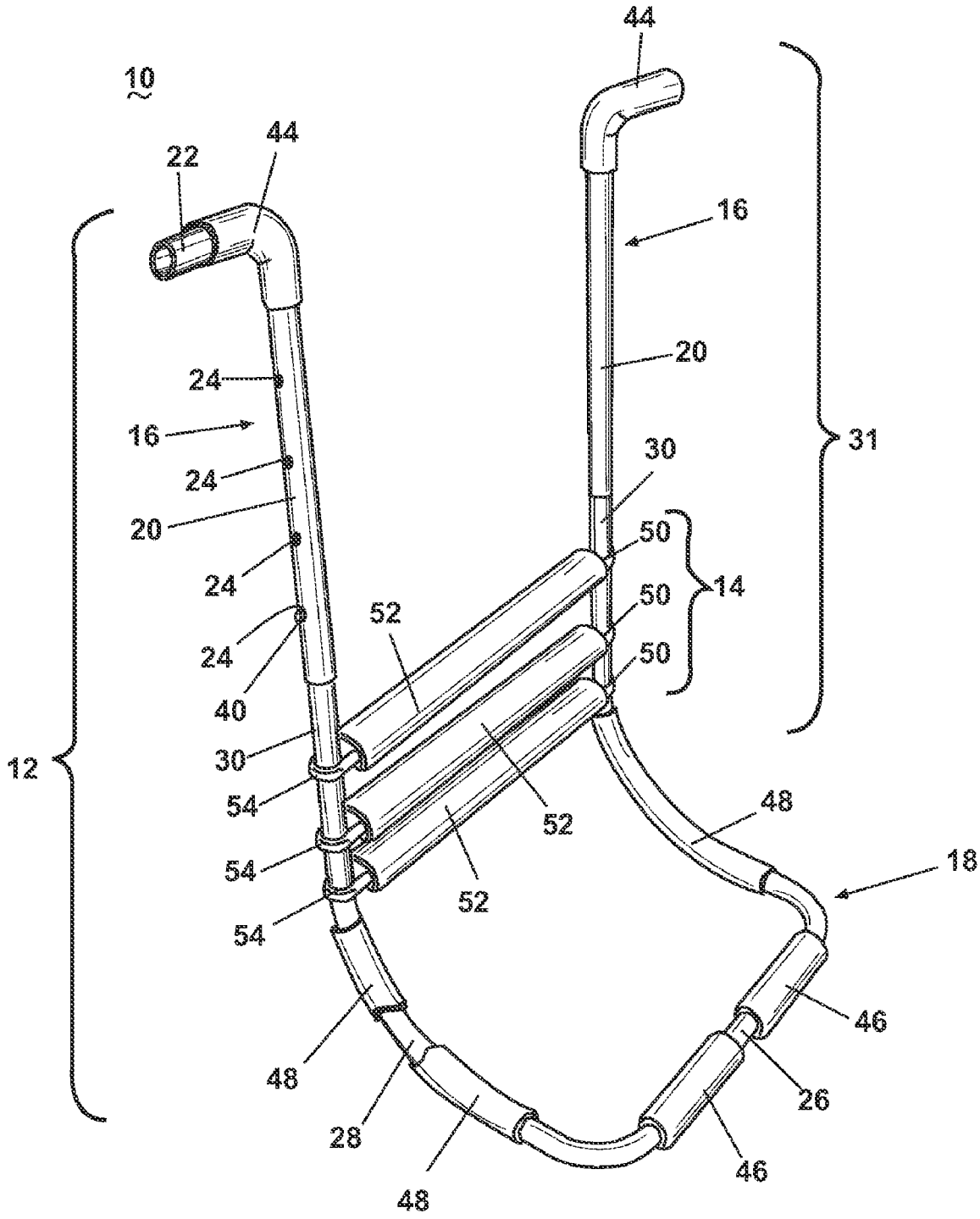
FIG. 1 is a perspective view of a universal exercise article according to the invention comprising a tubular frame and elastic resistance members, the tubular frame comprising a lower frame and an adjustable upper frame assemblywith two handles.

Referring to the drawings and to FIGS. 1-4 in particular, a universal exercise article 10 is shown comprising a tubular frame 12 and elastic resistance members 14 suspended therein. In the preferred embodiment, the frame 12 comprises a pair of L-shaped legs 16 defining an upper frame assembly 31, and a lower frame portion 18. The legs 16 and the lower frame portion 18 are preferably made of rigid, lightweight metal tubing, such as aluminum or steel. The frame 12 is thus formed in a generally U-shape wherein the lower frame 18 is bent forwardly and the upper portions of the legs 16 of the U-shape are bent laterally to form handles 22.

Figure 2:
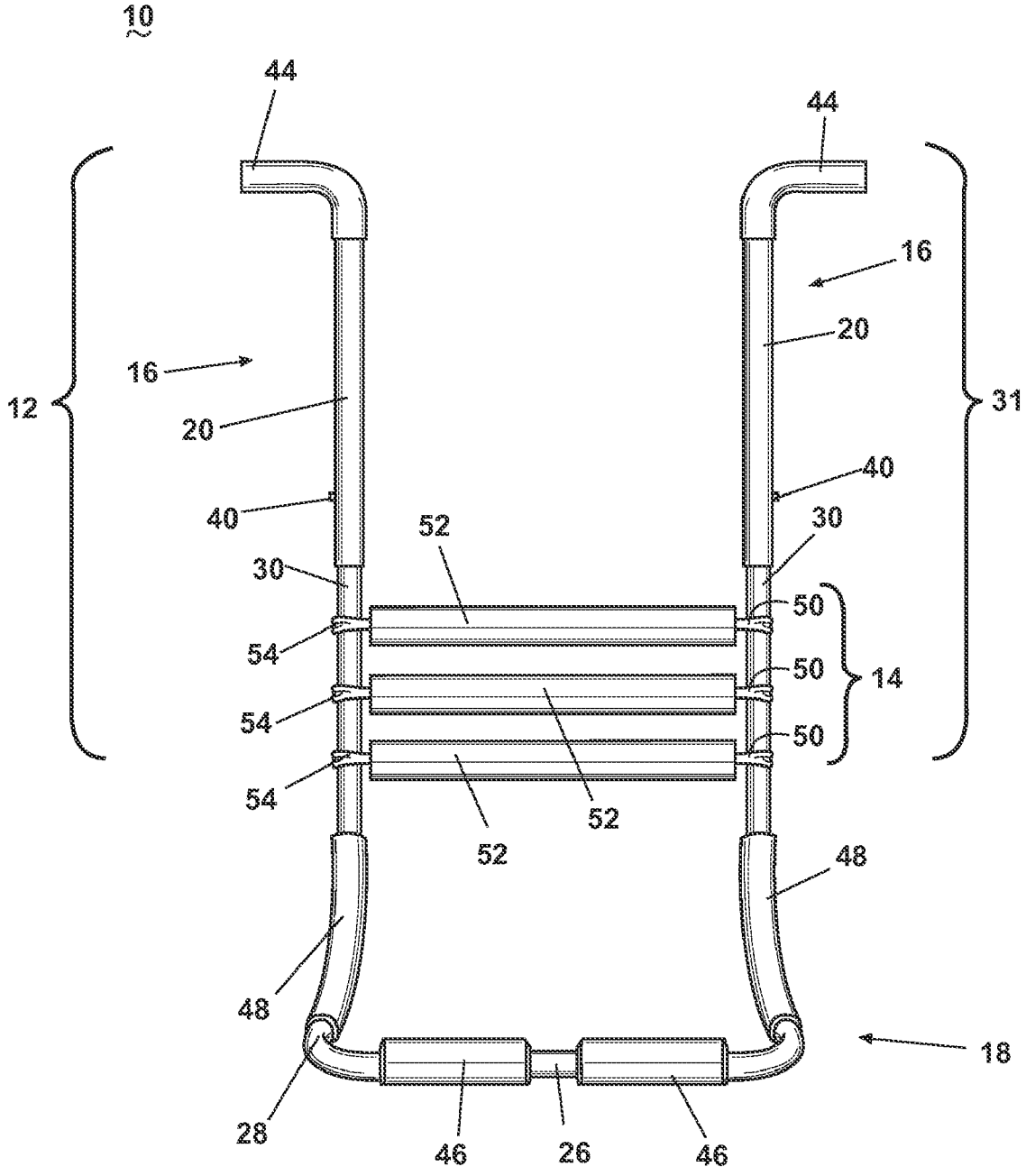
FIG. 2 is a front elevation view of the universal exercise article of FIG. 1.

In one embodiment, each leg 16 comprises an elongated shaft 20 and a handle 22 extending orthogonal thereto. In FIG. 1, the handles 22 are shown extending from the ends of the shafts 20. Alternatively, more than one pair of handles can be provided at various positions on the frame 12. The shaft 20 is provided with a plurality of longitudinally-spaced pin apertures 24. As shown in FIG. 2, the lower frame portion 18 is a generally U-shaped member comprising a bight section 26, a pair of rocker sections 28, and a pair of shaft sections 30 in parallel relationship. Each shaft section 30 is provided with a pin aperture 32, preferably proximate to its free end. As viewed in FIG. 3, each rocker section 28 is bent forwardly from the plane of the shafts 20 so that the bight section 26 is positioned forwardly of the plane of the shafts 20 and handles 22. The bend in the rocker section 28 forms a generally arcuate profile. Alternatively, the bend can form a 90° angle.

Figure 4:
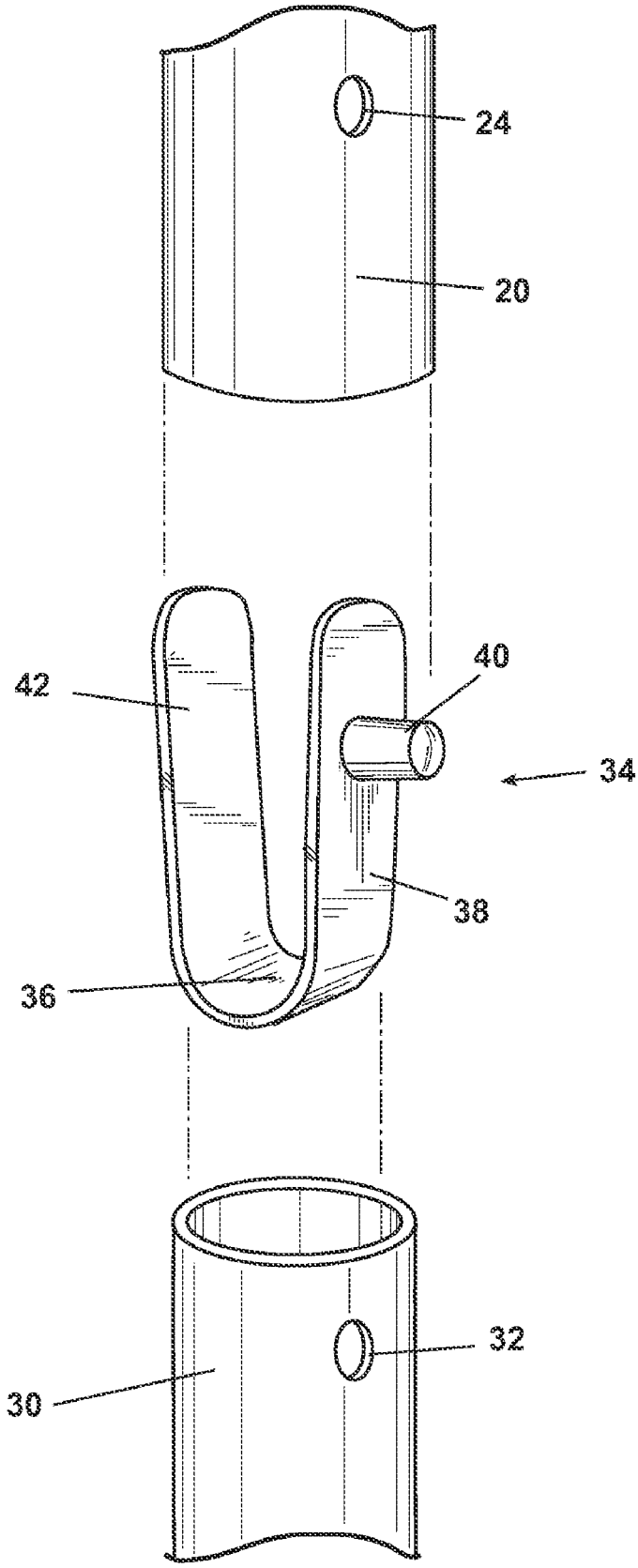
FIG. 4 is a detailed exploded view of a locking pin mechanism for securing the two handles to the lower frame of FIG. 1.

Referring now to FIG. 4, the outside diameter of the shaft section 30 is slightly less than the inside diameter of the shaft 20 so that the shaft section 30 is telescopingly and slidably retained within the shaft 20, thereby defining an frame assembly 31 extending generally from the rocker section 28 to the handle 22. The length of the frame assembly31 can be adjusted by adjusting the relative position of the shaft section 30 with respect to the shaft 20. The shaft section 30 is releasably retained within the shaft 20 to form an frame assembly31 of a desired length by the use of a pin mechanism 34 as hereinafter described.

The pin mechanism 34 comprises a generally U-shaped resilient band with a bight section 36, a pin arm 38, and a spring arm 42. In the preferred embodiment, the pin mechanism 34 comprises a band of resilient material, such as spring steel, which is bent into the U-shaped configuration to function as a spring hinge. The bight section 36 resiliently flexes when the pin arm 38 and the spring ann 42 move relative to one another. A pin 40 comprises a generally cylindrical, button-like member with a rounded end, and projects outwardly from the pin arm 38 proximate to its free end. The pin mechanism 34 is inserted into the shaft section 30, beginning with the bight section 36, until the pin 40 can be inserted through the pin aperture 32. The distance separating the free ends of the pin arm 38 and the spring arm 42 is selected so that the pin arm 38 and the spring arm 42 will be slightly compressed toward each other when the pin mechanism 34 is inserted into the shaft section 30. The pin 40 can thus be depressed through the pin aperture 32, and will return to its fully extended position when it is released.

With the pin mechanism 34 properly positioned in the shaft section 30, the shaft section 30 can be inserted into the shaft 20. The pin 40 is depressed so that the shaft section 30 can be inserted into the shaft 20 until the pin 40 registers with one of the pin apertures 24, thus locking the shaft 20 and the shaft section 30 together. The pin apertures 24, 32 are aligned so that, when the shaft 20 and the shaft section 30 are locked together, the handles 22 will extend laterally of the frame 12 as shown FIG. 2. The length of the frame 12 can be adjusted by insertion of the pin 40 into a particular pin aperture 24, thus accommodating users of different heights.

The frame 12 is provided with cushions for comfort and safety. Referring again to FIG. 1, each handle 22 is provided with a handle cushion 44 extending generally from the free end of the handle 22 onto the shaft 20. The bight section 26 is provided with at least one cushion 46. In the preferred embodiment of FIG. 1, the bight section 26 is provided with two cushions 46. Each rocker section 28 is provided with a rocker cushion 48 extending generally from the bight section 26 to the shaft section 30. In the preferred embodiment, the cushions 44, 46, and 48 are comprised of resilient foam tubes that can be slidably placed over the handles 22, the bight section 26, and the rocker sections 28. Preferably, the cushions are fixedly attached to the frame by a suitable adhesive.

Figure 3:
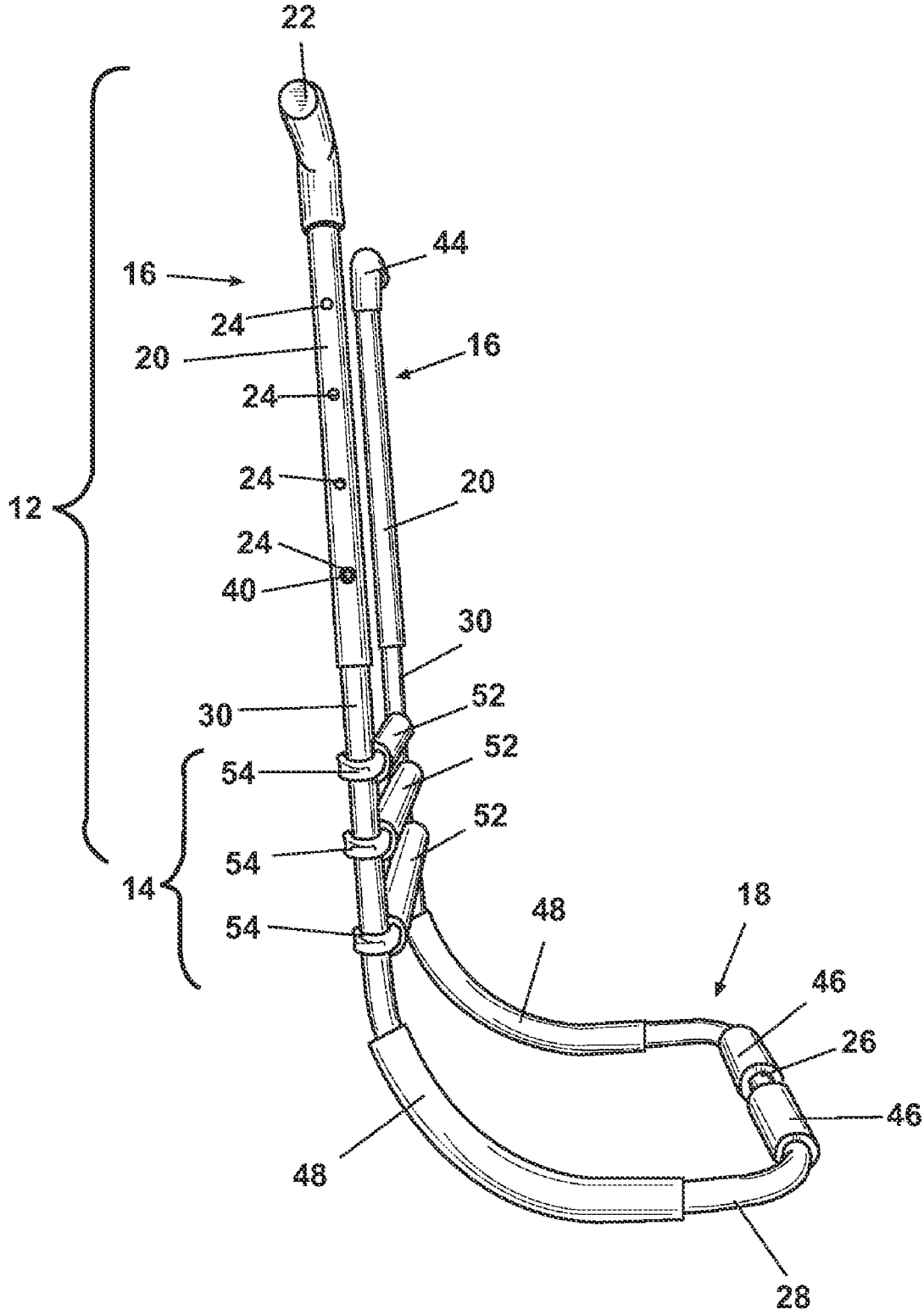
FIG. 3 is a side elevation view of the universal exercise article of FIG. 1.

As shown in FIGS. 1-3, each resistance member 14 comprises a resistance band 50 and a resistance band cushion 52. In the preferred embodiment, the resistance band 50 comprises a heavy-duty, endless band of resilient material, such as rubber or latex. The resistance band cushion 52 comprises a hollow, resilient foam tube. The resistance band 50 is inserted through the resistance band cushion 52, leaving a loop 54 of the resistance band 50 extending from each end of the cushion 52. Each frame assembly31 is inserted into one of the loops 54 so that the resistance band 50 is suspended therebetween. The size of the resistance band 50 is such that the suspended resistance band 50 will be in tension, and is slidable along the length of each of the arm assemblies 31 so that the resistance bands can be selectively positioned along the frame 12, depending upon the particular exercise being performed.

As illustrated in FIGS. 5-26, the resistance member 14 is typically placed against a portion of the user's body and provides a variable resistive force, proportionate to the number of resistance members 14 used and the magnitude of the deflection of the resistance member 14, against which the user works when the user performs a selected exercise. The tubular frame 12 can also be used alone without any resistance members 14.

FIGS. 5-26 illustrate the various exercises that can be performed with the universal exercise article 10. The figures show only a single resistance member 14 for the sake of clarity, although it will be understood that the number of resistance members 14 can be varied to suit a particular user's needs. As well, several of the exercises are shown being performed by a user seated in or using a chair. It will be understood that any convenient means of providing the necessary support for the person or the universal exercise article 10 can be used. Finally, for the sake of clarity, only the components of the universal exercise article 10 involved in a particular exercise have been numbered in FIGS. 5-26.

FIGS. 5-12 illustrate the use of the universal exercise article to perform exercises for strengthening the upper body. FIGS. 13-18 illustrate the use of the universal exercise article to perform exercises for strengthening the legs. FIGS. 19-26 illustrate the use of the universal exercise article to perform stretching exercises and exercises for strengthening the torso. It will be understood that, once the principles concerning the use of the universal exercise article are understood, the universal exercise article can be used to perform exercises in addition to those illustrated in FIGS. 5-26.

Figure 5:
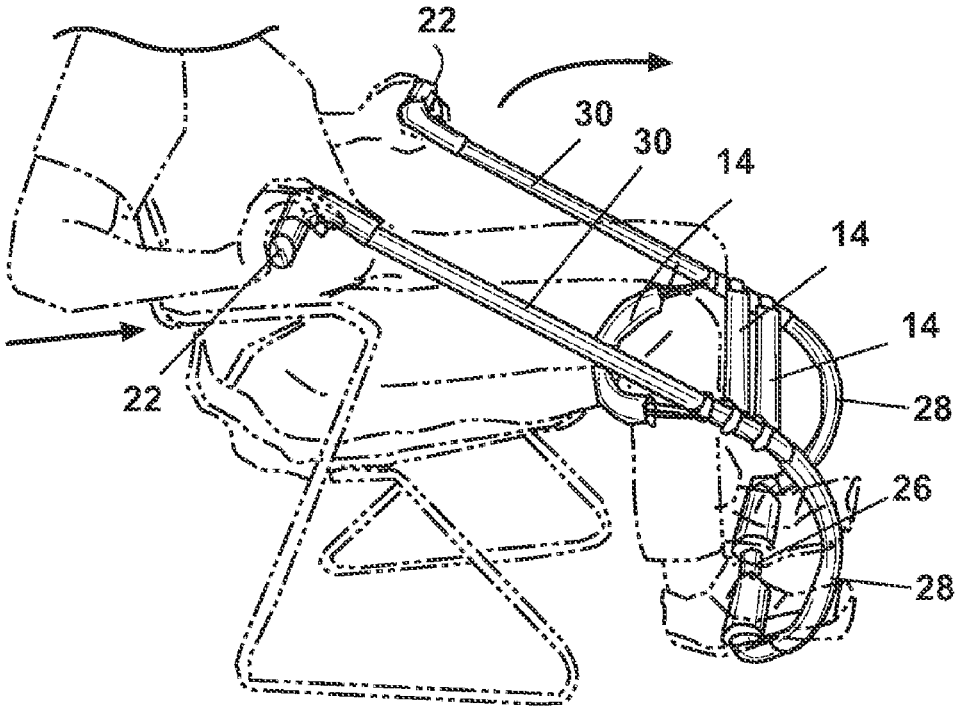
FIGS. 5-26 illustrate various exercises that can be performed utilizing the universal exercise article of FIG.

FIG. 5 illustrates the use of the universal exercise article to perform a chest press. The resistance member 14 is positioned on the frame assembly31. By placing the resistance member 14 behind the user's lower leg and bracing the bight section 26 under the user's feet, the user can perform a chest press by pushing on the handles 22 to pivot the frame 12 about the bight section 26, stretching the resistance member 14 against the user's leg.

Figure 6:
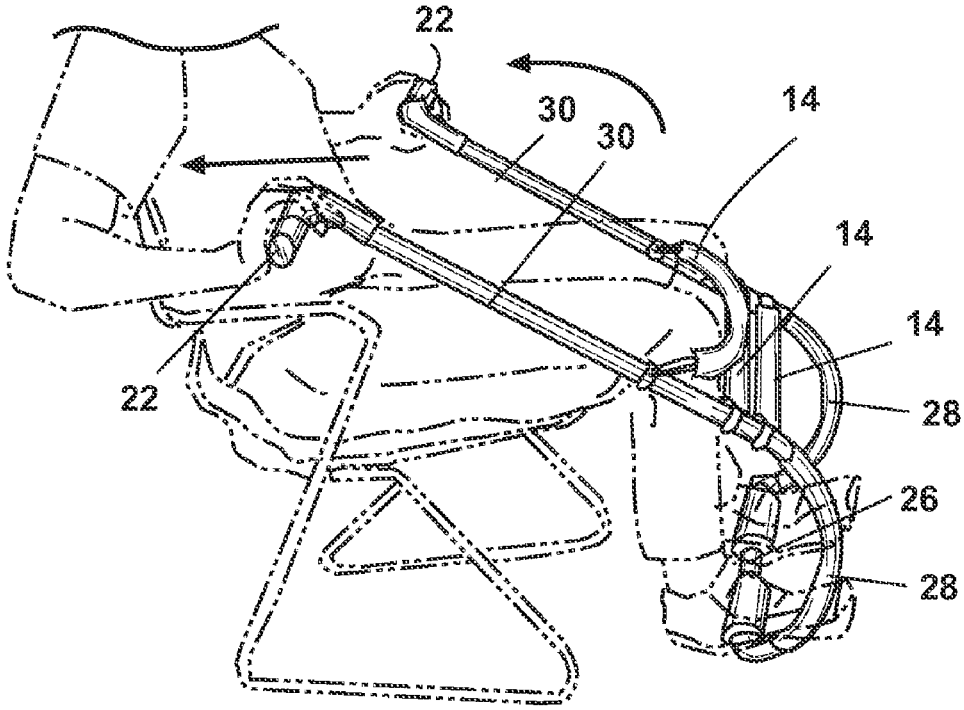

As illustrated in FIG. 6, to perform a chest pull, the user's feet again brace the bight section 26, but the resistance member 14 engages the front of the user's lower leg. The user pulls on the handles 22 to pivot the frame 12 about the bight section 26.

Figure 7:
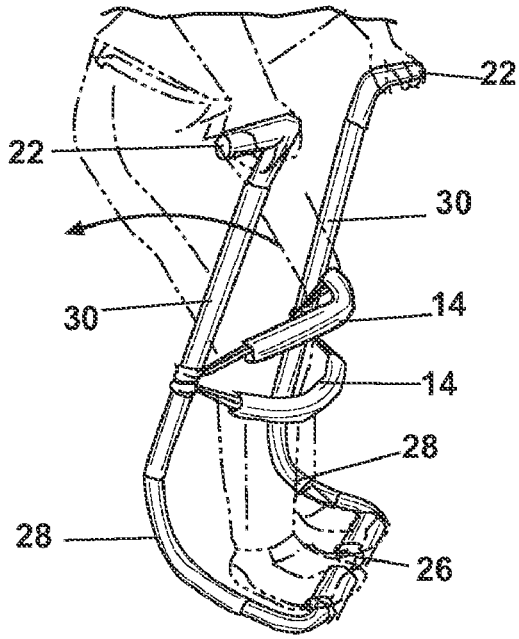

FIG. 7 illustrates the use of the universal exercise article to perform a triceps kickback. The bight section 26 is braced beneath the user's feet. The resistance member 14 is placed on the frame assembly31 across the front of the users legs. The user pushes the handles 22 to a posterior position, pivoting the universal exercise article 10 about the bight section 26, and stretching the resistance member 14 against the legs to work the triceps.

Figure 8:
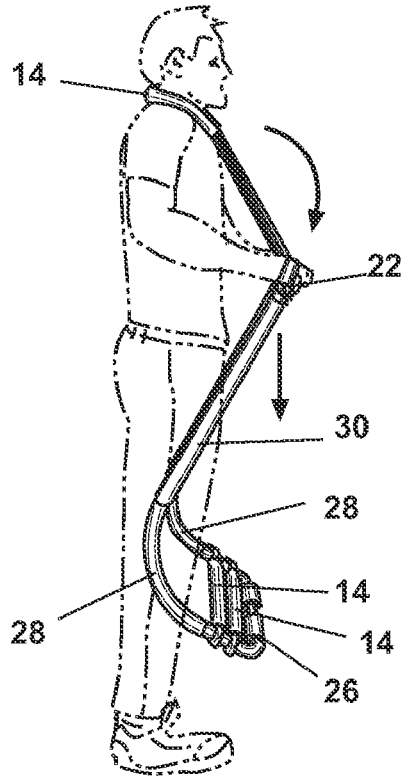

FIG. 8 illustrates a standing triceps extension. In this exercise, each end loop 54 of the resistance member 14 is looped around a handle 22. The resistance member 14 is looped around the back of the user's neck. The user pushes down on the handles 22, stretching the resistance member 14, and working the triceps.

Figure 9:
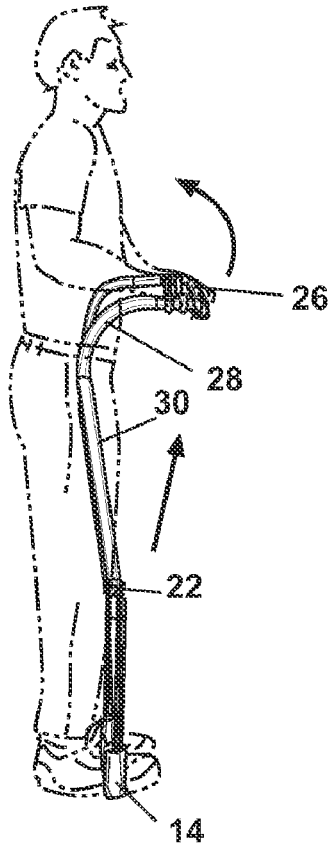

FIG. 9 illustrates a standing curl. Each end loop 54 of the resistance member 14 is again looped around a handle 22. The user grasps the bight section 26, palm-side up, and stands on the resistance member 14. The curl is performed in a conventional manner, stretching the resistance member 14, and working the biceps.

Figure 10:
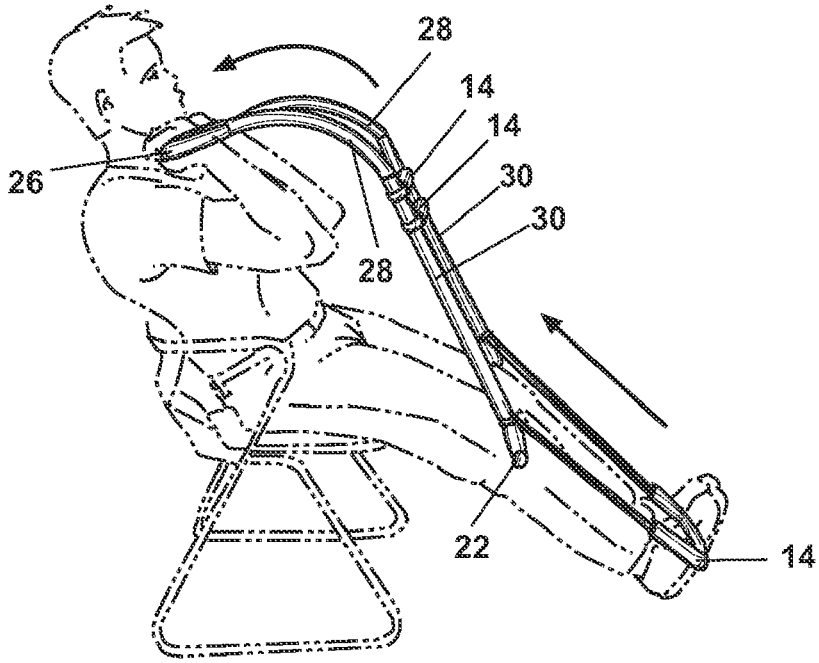

As shown in FIG. 10, curls can also be performed from a seated position. The position of the resistance member 14 and the grasping of the universal exercise article 10 by the user is the same as for the standing curl.

Figure 11:
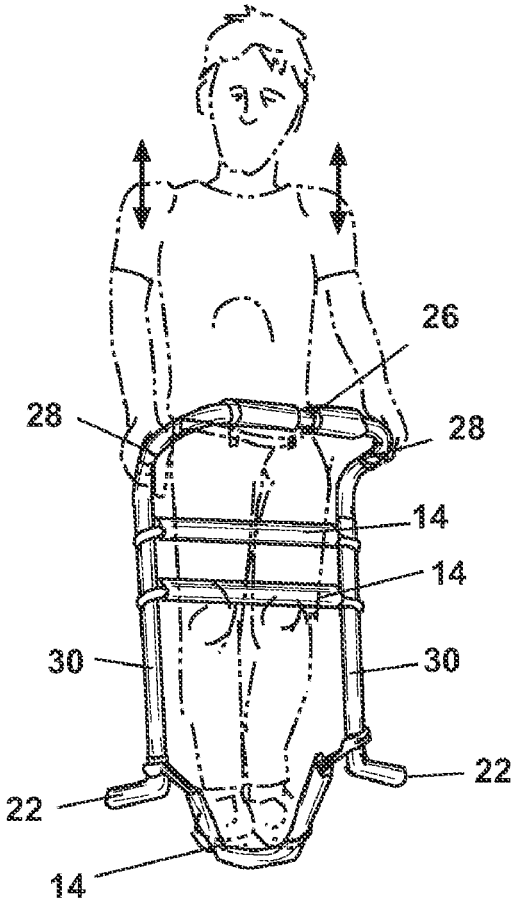

FIG. 11 illustrates the use of the universal exercise article to perform shoulder shrugs. For this exercise, the frame 12 is suitably shortened by extending the shaft section 30 into the shaft 20. The end loops 54 of the resistance member 14 are looped around the handles 22, and the user stands on the resistance member 14, grasping the bight section 26 near the rocker section 28. Keeping the arms straight, the shoulders are lifted and rotated against the resistance provided by the resistance member 14.

Figure 12:
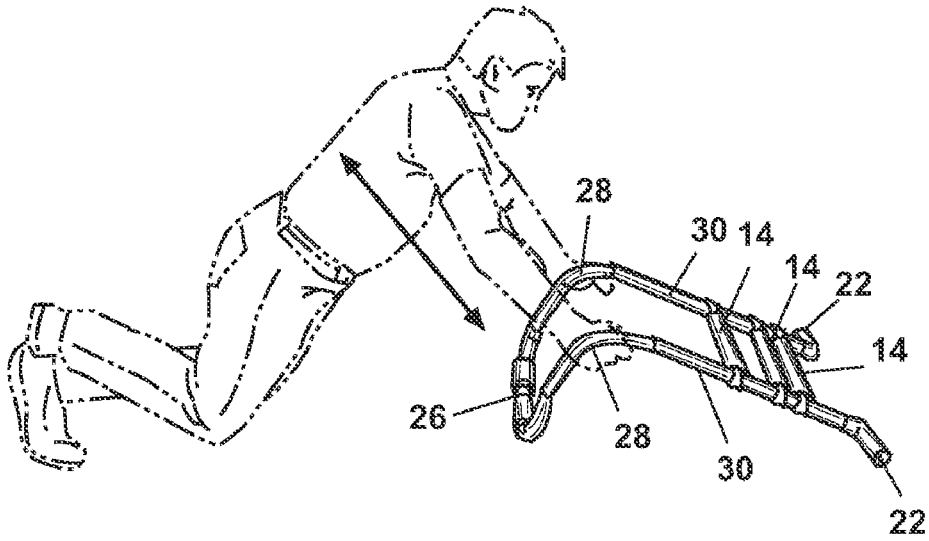

FIG. 12 illustrates the use of the universal exercise article to perform push-ups. For this exercise, the universal exercise article is supported on a horizontal surface on the bight section 26 and the handles 22. The user grasps the rocker sections 28 and performs a conventional push up. The universal exercise article enables the user to perform a deeper push up than would be possible without the universal exercise article. No resistance member 14 is used.

Figure 13:
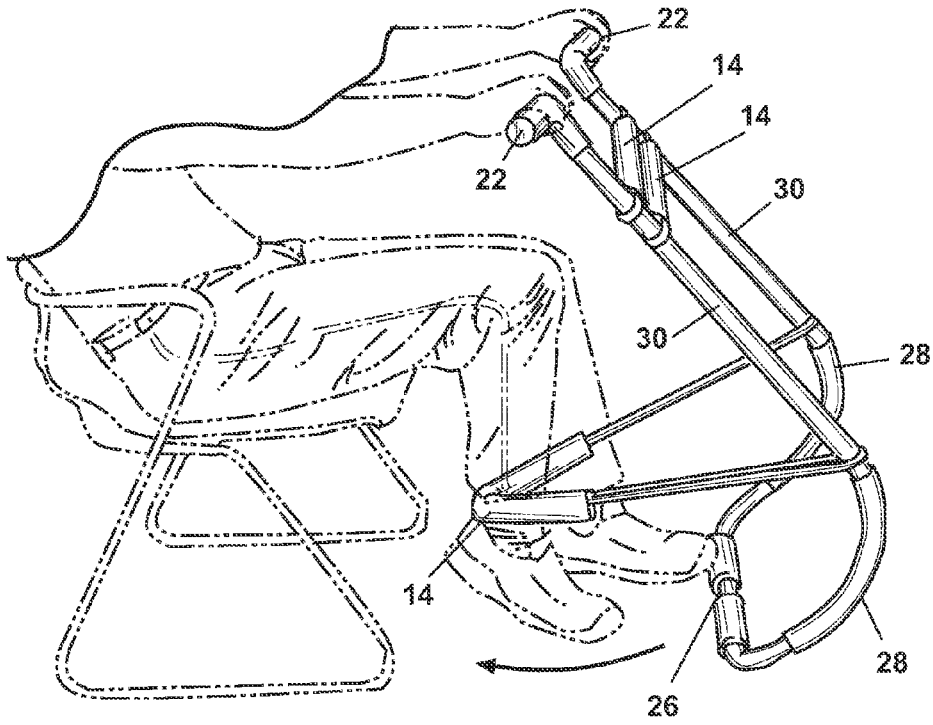

FIG. 13 illustrates the use of the universal exercise article to perform a leg curl. The resistance member 14 is looped around the arm assemblies 31 proximate to the rocker section 28, and the bight section 26 is braced by one of the user's feet. The resistance member 14 is placed behind the user's ankle and the user grasps the handles 22, keeping the arms straight to maintain the universal exercise article 10 in a fixed position. The leg is curled toward the user against the resistance member 14.

Figure 14:
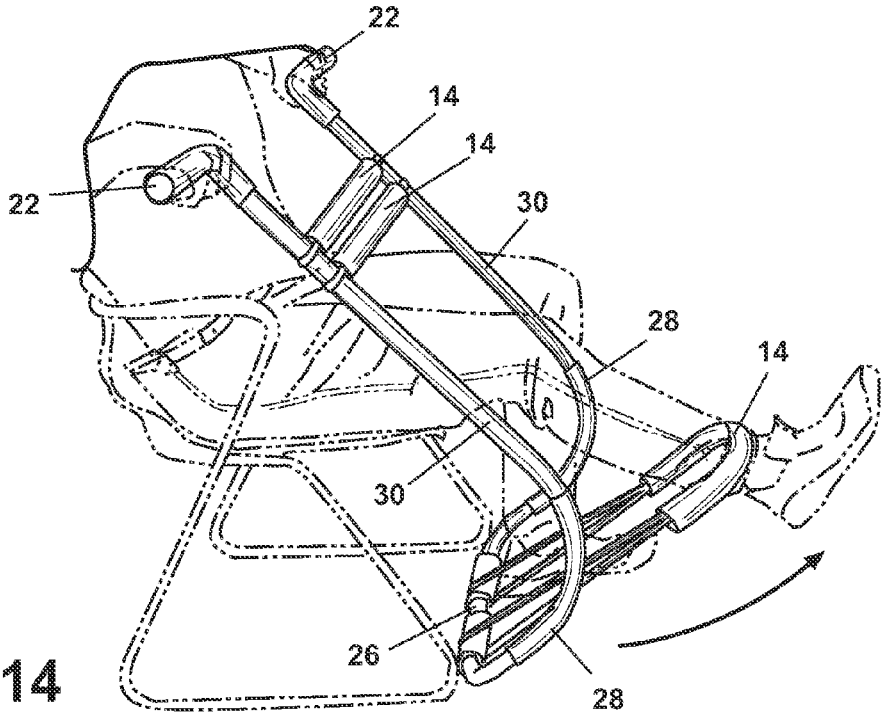

FIG. 14 illustrates the use of the universal exercise article to perform a leg extension. For this exercise, the resistance member 14 is looped around the bight section 26. The bight section 26 is braced against a chair or other solid object, and the user grasps the handles 22, keeping the universal exercise article 10 in a fixed position. The user's leg is placed in the loop formed by the resistance member 14, and is extended against the resistance of the resistance member 14.

Figure 15:
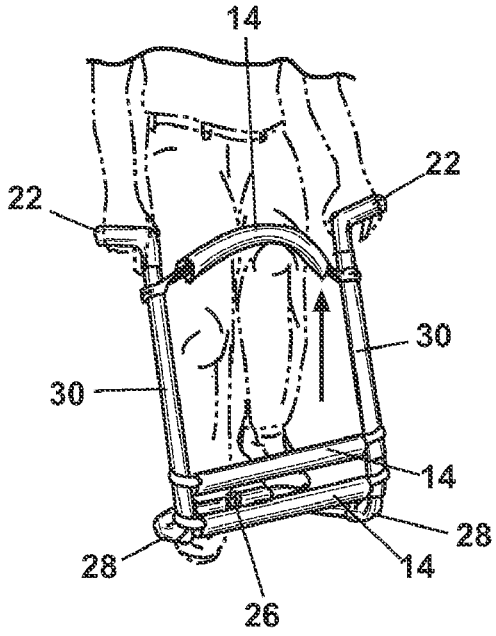

FIG. 15 illustrates the use of the universal exercise article to walk in place against resistance. The resistance member 14 is positioned on the arm assemblies 31 proximate to the handles 22. The bight section 26 is placed on the floor, and the user pushes down on the handles 22 to maintain the bight section 26 against the floor. The legs are alternately raised against the resistance of the resistance member 14 and lowered in a "high-stepping" action.

Figure 16:
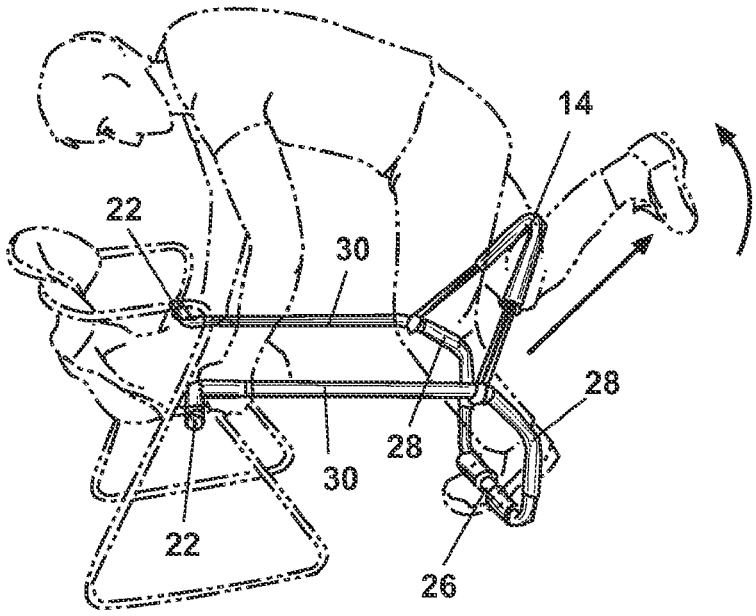

FIG. 16 illustrates the use of the universal exercise article to perform a leg kick. For this exercise, the resistance member 14 is placed at the junction of the frame assembly31 and the rocker section 28. The handles 22 are placed on a chair or other suitable horizontal surface. The bight section 26 is placed on the floor and braced by the user's foot. The resistance member 14 is placed behind the user's knee, and the user grasps the arm assemblies 31 proximate to the handles 22. The leg is extended upward and outward against the resistance of the resistance member 14.

Figure 17:
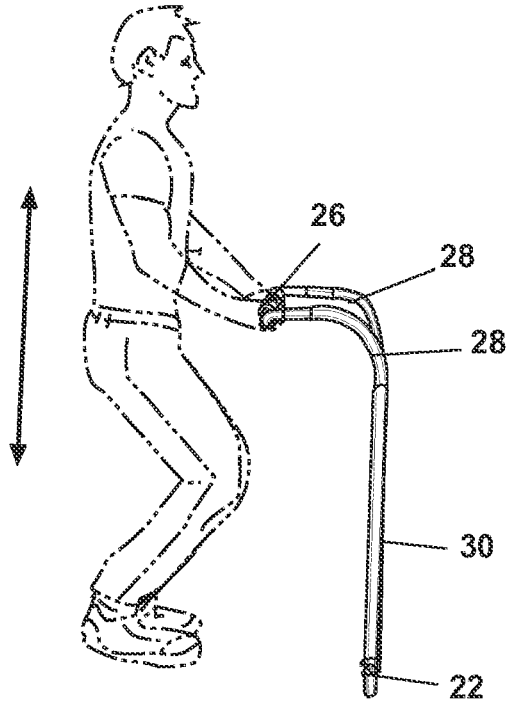

FIGS. 17 illustrates the use of the universal exercise article to perform a squat. The handles 22 are placed on the floor and the user grasps the bight section 26. The universal exercise article is used by the user to maintain balance during the performance of the exercise. No resistance members 14 are used.

Figure 18:
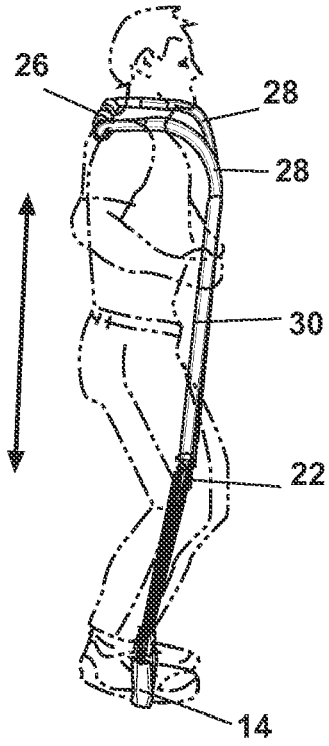

FIG. 18 illustrates the use of the universal exercise article to perform a squat against resistance. For this exercise, the resistance member 14 is positioned at the junction of the handles 22 and the arm assemblies 31. The user stands on the resistance member 14 and places the bight section 26 against the back of his or her neck, grasping the arm assemblies 31. The resistance member 14 is alternately stretched and relaxed as the squats are performed.

Figure 19:
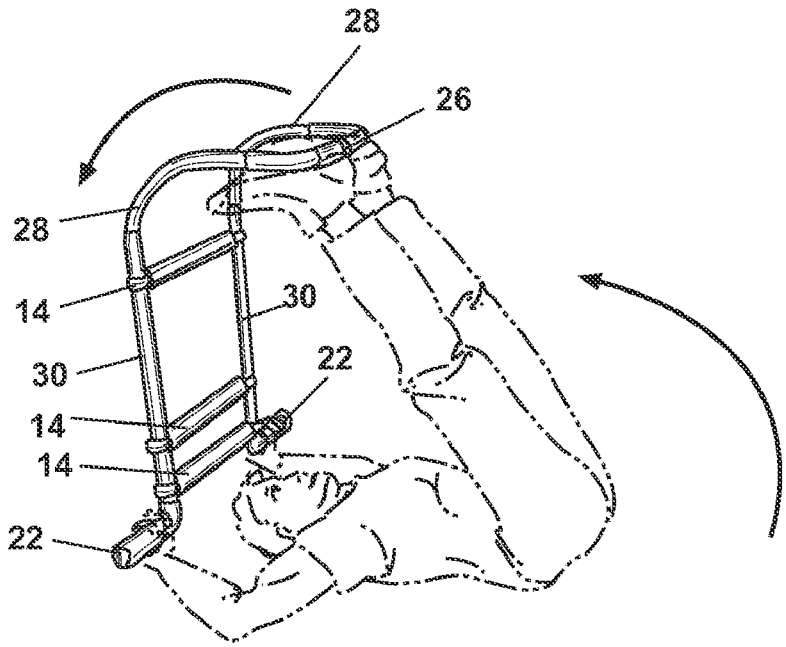

FIG. 19 illustrates the use of the universal exercise article to perform a lower back and leg stretch. The user lies faceup on a horizontal surface and grasps the handles 22. The bight section 26 is placed against the soles of the feet. The users legs are kept straight and the universal exercise article 10 is held in place by the user pulling the universal exercise article 10 against his or her feet. The legs are alternately raised and lowered together, and are stretched by the user pulling on the handles 22 to bring the legs forward.

Figure 20:
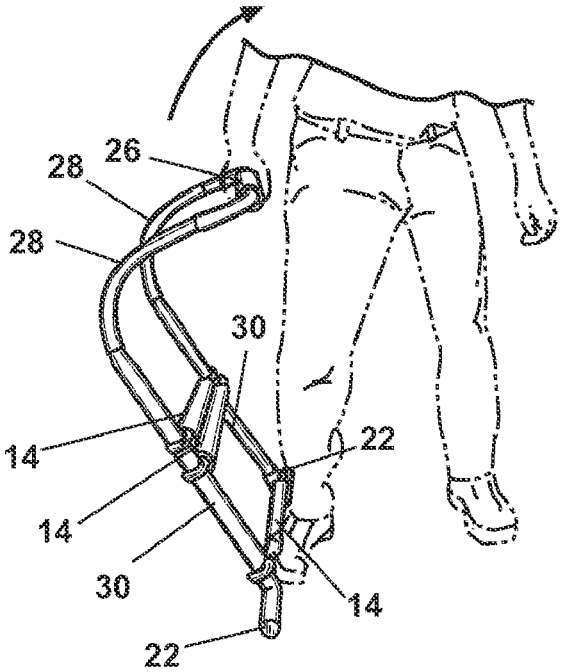

FIG. 20 illustrates the use of the universal exercise article to perform a side bend against resistance. The resistance member 14 is placed at the junction of the handles 22 and the arm assemblies 31. The user grasps the bight section 26 and stands with one foot on the resistance member 14 with the universal exercise article 10 at the user's side. Keeping a straight arm, the user bends to the side away from the universal exercise article 10 against the resistance of the resistance member 14.

Figure 21:
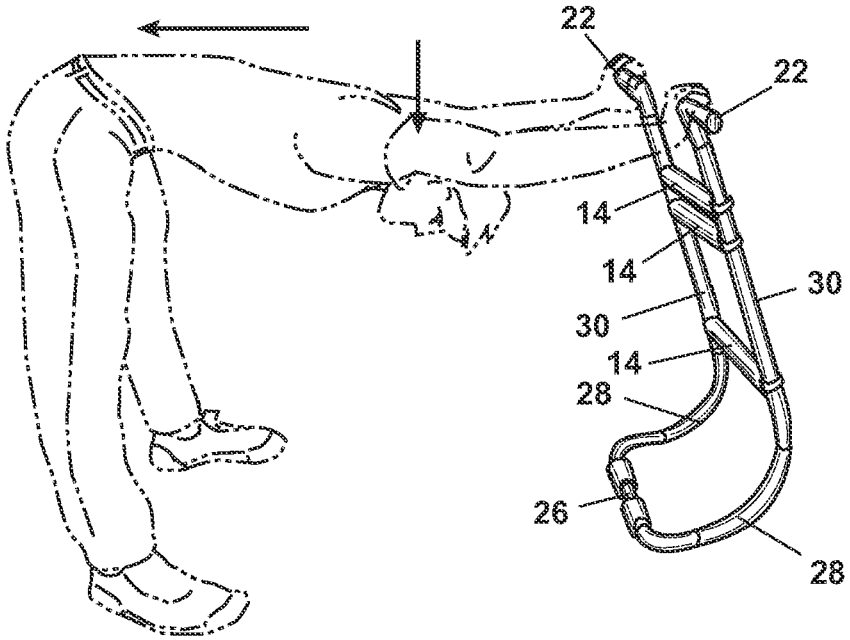

FIG. 21 illustrates the use of the universal exercise article to perform a lower back and shoulder stretch. The user grasps the handles 22, palm side down, and places the bight section 26 on the floor. The user bends at the waist, while rocking the universal exercise article 10 about the bight section 26, keeping the arms straight and using the universal exercise article 10 to maintain balance while performing the exercise.

Figure 22:
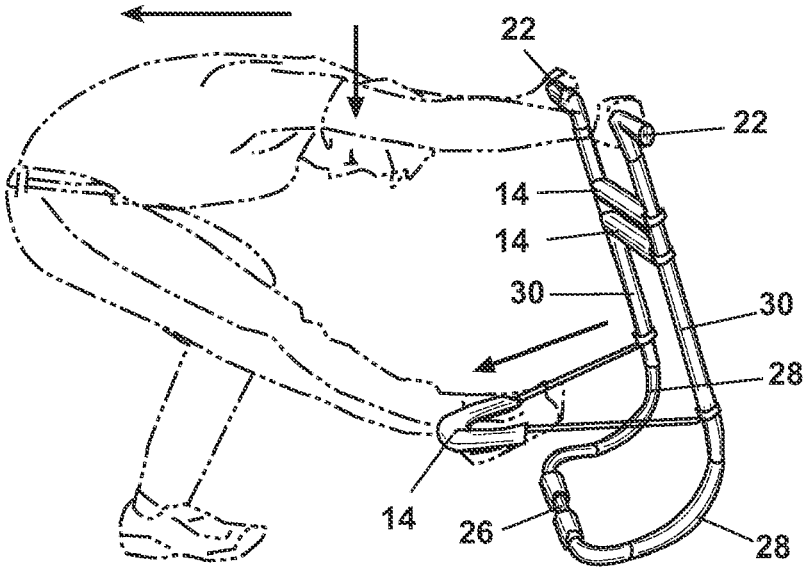

FIG. 22 illustrates the use of the universal exercise article to perform a combined upper body and leg stretch. The resistance member 14 is placed around the arm assemblies 31. The user grasps the handles 22, palm side down, and places the bight section 26 on the floor, placing the resistance member 14 behind an ankle. While standing on one foot, the user bends at the waist, rocking the universal exercise article 10 about the bight section 26, keeping the arms straight, pushing on the handles 22, and stretching the leg against the resistance member 14.

Figure 23:
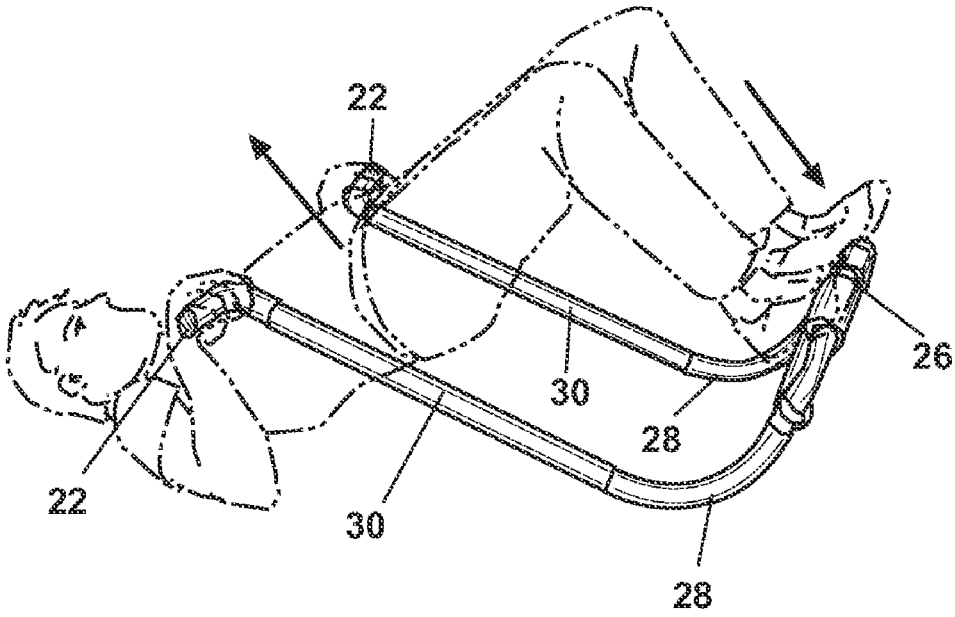
Figure 24:
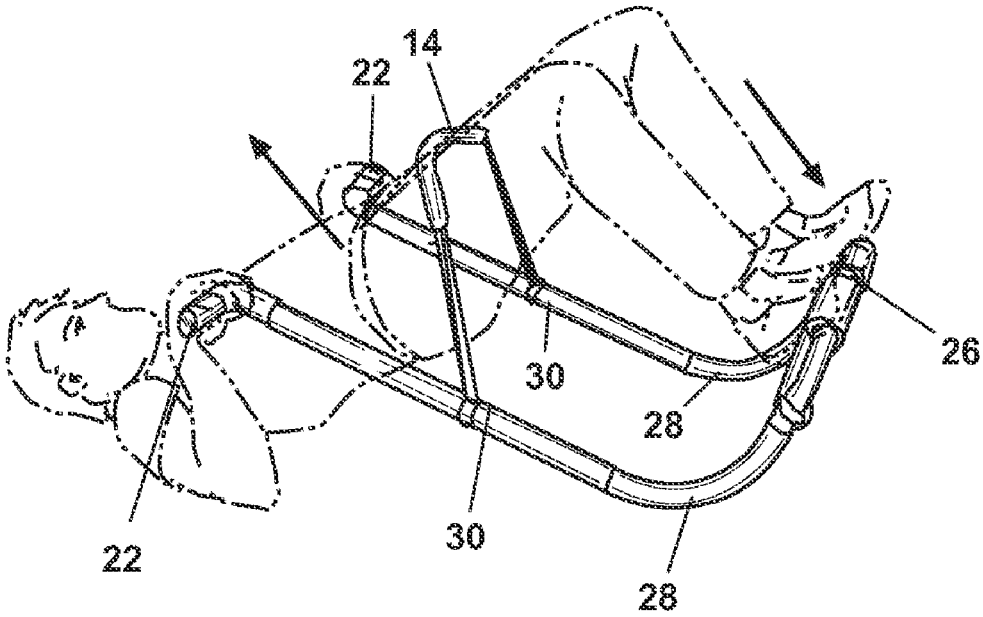

FIGS. 23 and 24 illustrate the use of the universal exercise article to perform a torso stretch, with and without resistance, respectively. For both exercises, the user lies faceup on a horizontal surface with the bight section 26 extending upward, and the rocker sections 28 contacting the floor. The user grasps the handles 22 with the feet on the bight section 26. The user then lifts his or her torso off the floor, supporting his or her body weight on the shoulders and feet. The universal exercise article 10 is balanced on the rocker sections 28 during the lifting of the torso. Placement of the user's feet on the bight section 26 enables the user to increase the elevation of the torso. As illustrated in FIG. 23, no resistance member 14 is used. As illustrated in FIG. 24, a resistance member 14 can be positioned around the arm assemblies 31 to contact the user's waist or thighs so that the torso elevation can be performed against the resistance member 14.

Figure 25:
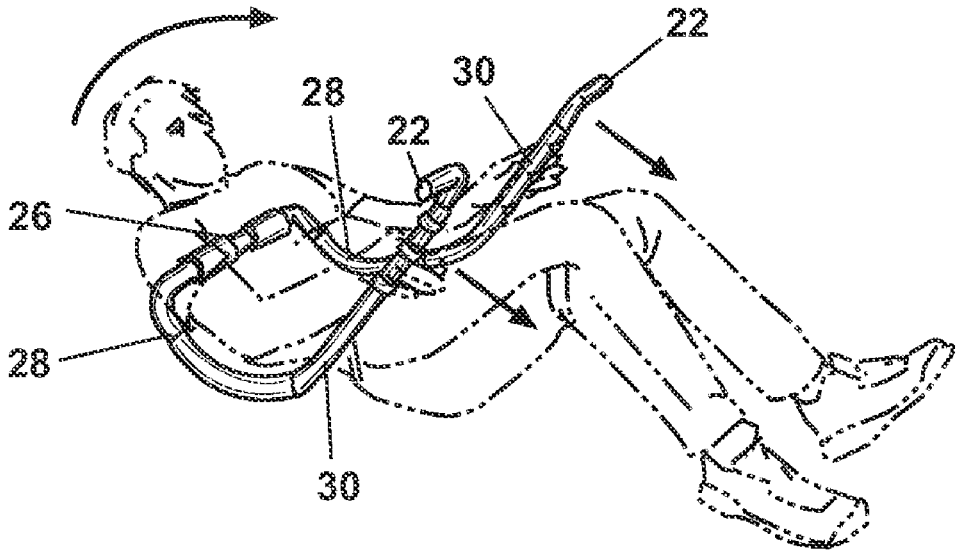
Figure 26:
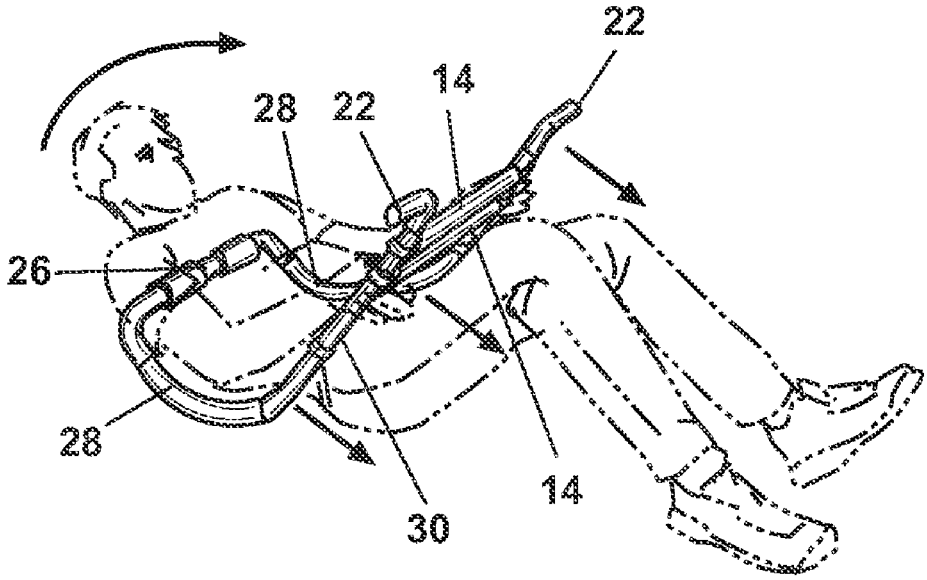

FIGS. 25 and 26 illustrate the use of the universal exercise article to perform assisted abdominal crunches, with and without resistance, respectively. For both exercises, the user lies faceup on a horizontal surface with the bight section 26 behind the user's neck or upper back. The rocker sections 28 contact the floor, and the user grasps the arm assemblies 31, which extend along and to the outside of the user's legs. The user performs the crunches by lifting the upper body, pushing down on the arm assemblies 31 to rock the universal exercise article 10 along the rocker sections 28 and assist in raising the upper torso. As illustrated in FIG. 26, the resistance member 14 can be positioned along the arm assemblies 31 and across the front of the user's thighs, thus providing resistance during the exercise when the arm assemblies 31 are pushed downward.

FIGS. 27-30 illustrate alternative embodiments of the frame assembly31. For clarity, only the upper portion of the frame assembly 31 is shown. As well, elements common to each embodiment illustrated in FIGS. 1-4 and 27-30 are given the same numbering throughout. It will be understood that the length of the shaft 20 will generally be the same in each embodiment, as will the number and spacing of the pin apertures 24.

Figure 27:
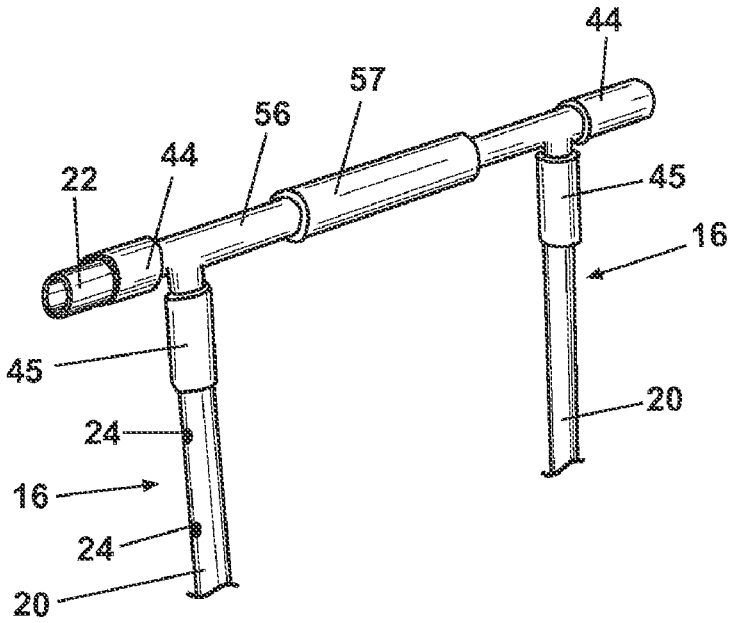
FIGS. 27-30 are perspective views of alternative embodiments of the upper frame assembly of the universal exercise article of FIGS. 1-4.

In the embodiment illustrated in FIG. 27, the shafts 20 are connected by a tubular crossbar 56. The crossbar 56 extends between the handles 22 and is axially aligned therewith. The crossbar 56 may be provided with at least one crossbar cushion 57, preferably comprising a resilient foam tube that is attached to the crossbar 56 by a suitable adhesive. The handle cushion 44 extends generally from the free end of the handle 22 to the shaft 20. A shaft cushion 45 is provided at the upper end of each shaft 20 proximate to the handle 22 and the crossbar 56.

Figure 28:
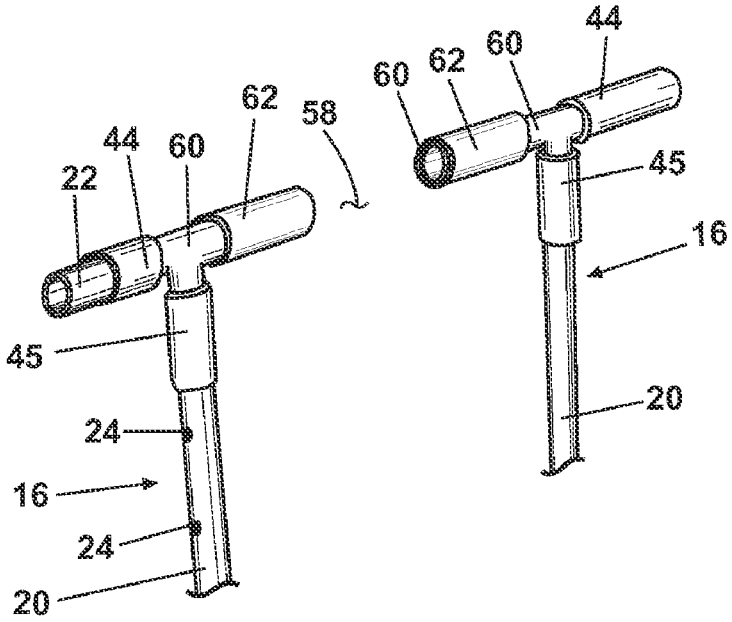

In the embodiment illustrated in FIG. 28, each shaft 20 terminates in a handle 22 and a crosspiece 60 to form a generally T-shaped structure in which the handles 22 and crosspieces 60 are axially aligned. The crosspieces 60 extend inwardly of the shafts 20 to define a crosspiece gap 58. Each crosspiece 60 is provided with a crosspiece cushion 62, preferably comprising a resilient foam tube that is attached to the crosspiece 60 by a suitable adhesive. The crosspiece cushion 62 extends generally from the free end of the crosspiece 60 to the shaft 20. The handle cushion 44 extends generally from the free end of the handle 22 to the shaft 20. A shaft cushion 45 is provided at the upper end of each shaft 20 proximate to the handle 22 and the crosspiece 60.

Figure 29:
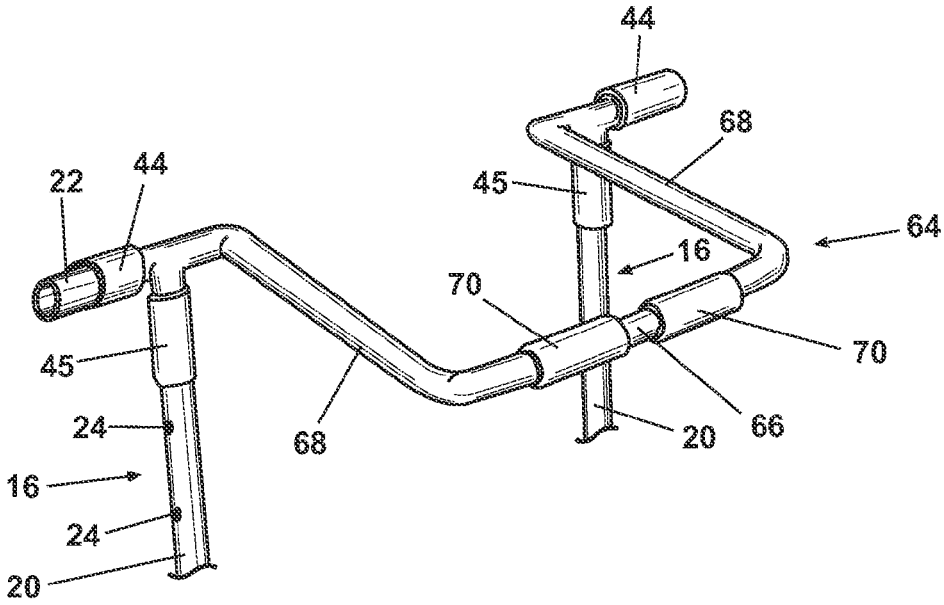
Figure 30:
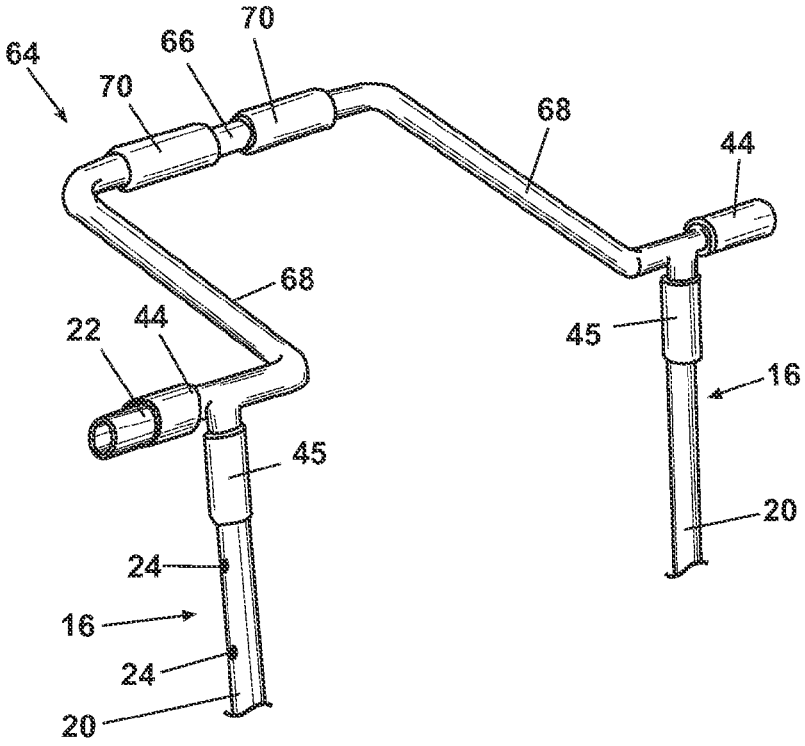

In the embodiment illustrated in FIG. 29, the shafts 20 are connected by a U-shaped upper frame assembly 64 wherein the upper frame assembly 64 is bent forwardly of the shafts 20. The upper frame assembly 64 forms a generally U-shape, and comprises a bight section 66 and a pair of upper frame arms 68 in parallel relationship. The bight section 66 is provided with at least one bight cushion 70. In the preferred embodiment of FIG. 1C, the bight section 66 is provided with two bight cushions 70. The upper frame arms 68 can extend from the T-shaped handles 22 illustrated in FIG. 28. Alternatively, the upper frame arms 68 can extend from the upper end of the shafts 20. Each upper frame arm 68 is bent forwardly from the plane of the shafts 20 so that the bight section 66 is positioned forwardly of the plane of the shafts 20 and handles 22. Each shaft 20 and attached upper frame arm 68 forms a generally 90° angle. Alternatively, the attachment of the upper frame arm 68 to the shaft 20 can form a generally arcuate profile. The handles 22 extend laterally from the shafts 20 as in the previous embodiments. The handle cushion 44 extends generally from the free end of the handle 22 to the shaft 20. A shaft cushion 45 is provided at the upper end of each shaft 20 proximate to the handle 22 and the upper frame arm 68. In FIG. 29, the upper frame assembly 64 is shown extending generally in the same direction from the arm assemblies 31 as the lower frame portion 18. It will be readily understood that the arm assemblies 31 and upper frame assembly 64 can be repositioned relative to the lower frame portion 18 so that the upper frame assembly 64 extends in a generally opposite direction from the lower frame portion 18, as illustrated in FIG. 30.

Figure 31:
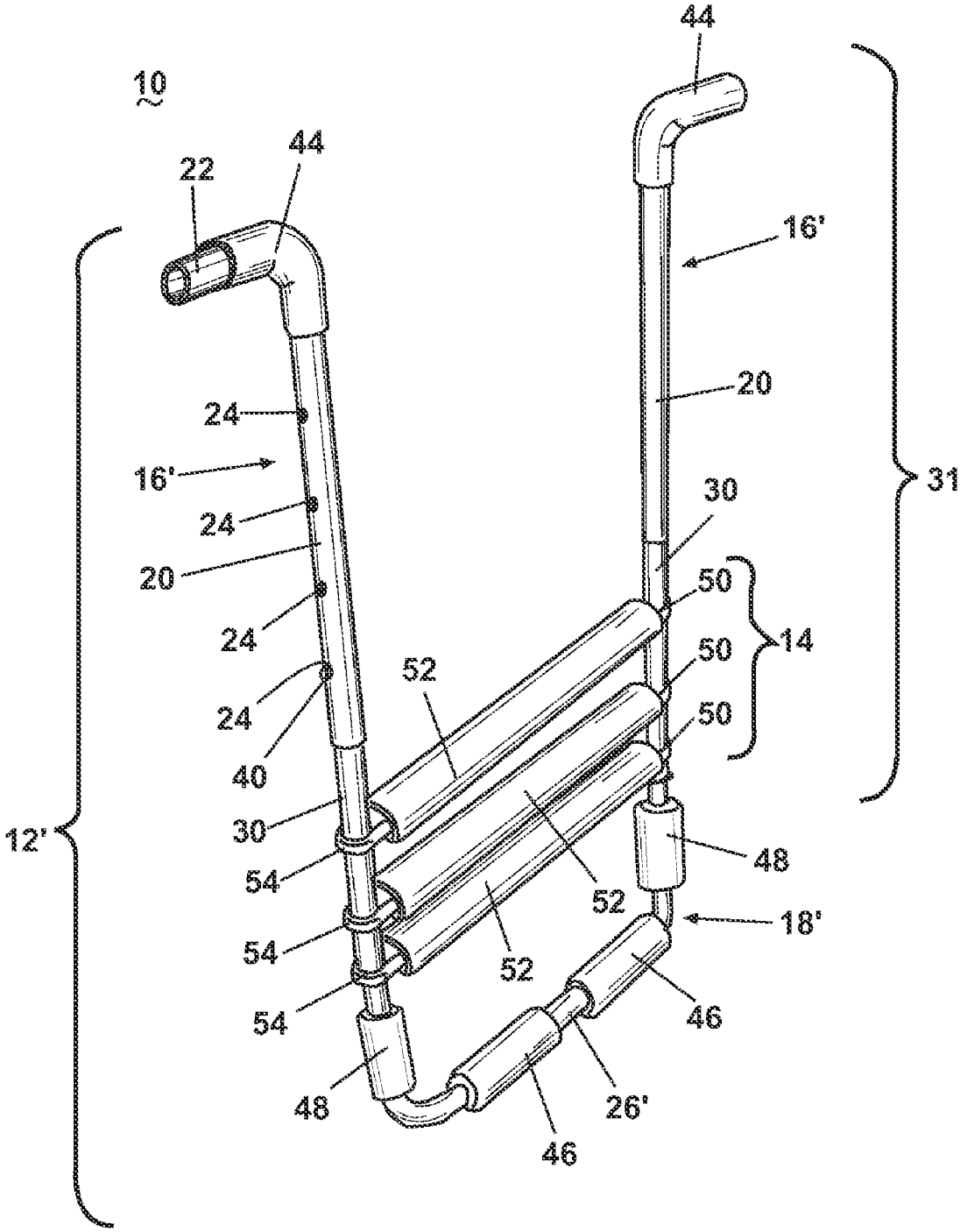
FIG. 31 is a perspective view of a universal exercise article according to yet another embodiment of the invention.

Referring now to FIG. 31 where like numerals have been used to designate like parts, the universal exercise article is constructed essentially according to the exercise device illustrated in FIGS. 1-3 except that the legs 16 are essentially straight along the entire length thereof and are joined to the bight section 26 that lies in the same plane as the plane of the legs 16'. Thus, the rocker section 28 in FIGS. 1-3 is eliminated in the embodiment of FIG. 31.

While the invention has been specifically described in connection with certain specific embodiments thereof, it is to be understood that this is by way of illustration and not of limitation. Reasonable variation and modification are possible within the scope of the forgoing description and drawings without departing from the spirit of the invention.

I claim:

1. A universal exercise device comprising:

a rigid frame of a size to be gripped by a user and used for multiple exercises, the rigid frame formed generally in a U-shape with parallel legs of the U-shape having upper portions thereof lying generally in a plane, having inwardly directed arms forming a T-shape at the upper portion of each leg;

a bight portion of the U-shape joining the legs at lower portions thereof;

handles formed by outwardly bent portions at an upper portion of the legs for gripping by a user; and at least one resilient resistance member spanning the legs and of sufficient strength to yieldably resist deformation with respect to the legs when pressed by a user of the device while otherwise holding the frame against the elongation of the resilient resistance member.

2. A universal exercise device according to claim 1, wherein the lower portions of the legs are bent outwardly of the plane thereof to form generally L-shaped legs with the bight section outward of the plane of the upper portions of the legs.

3. A universal exercise device according to claim 2, wherein the lower portions of the legs are bent through a relatively wide arc to form a rocker portion between the upper portions of the legs and the bight portion, whereby the user can rock on the relatively wide arc.

4. A universal exercise device according to claim 2, wherein the legs are joined together at an upper portion with a crosspiece.

5. A universal exercise device according to claim 4, wherein the crosspiece is U-shaped and projects out of the plane of the legs.

6. A universal exercise device according to claim 5, wherein the crosspiece projects out of the plane of the leg in a direction opposite to the position of the bight portion.

7. A universal exercise device according to claim 1, wherein the bight portion of the rigid U-shaped frame lies substantially in the plane of the upper portion of the legs.

8. A universal exercise device according to claim 1, wherein the legs are formed of inner and outer telescoping tubes for adjustment of the length of the legs to accommodate users of different heights.

9. A universal exercise device according to claim 8 and further comprising a selective locking mechanism between the inner and outer telescoping tubes for selectively locking the tubes in selected adjustable positions.

10. A universal exercise device according to claim 9, wherein the locking mechanism comprises a pin resiliently mounted within the inner tube and projecting through an aperture in the inner tube, and multiple aligned pin receiving apertures in the outer tube.

11. A universal exercise device according to claim 10 and further comprising a U-shaped spring mounted within the inner tube and forming the resilient mounting of the pin within the inner tube.

12. A universal exercise device comprising:

a rigid frame of a size to be gripped by a user and used for multiple exercises, the rigid frame formed generally in a U-shape comprising parallel legs, the parallel legs having upper portions thereof lying generally in a plane;

lower portions bent outwardly of the plane to form generally L-shaped legs with a bight section joining the legs at lower portions thereof outward of the plane of the upper portions;

a U-shaped crosspiece joining the legs and projecting out of the plane of the legs in a direction opposite to the position of the bight section; and handles formed by outwardly bent portions at an upper portion of the legs for gripping by a user; and at least one resilient resistance member spanning the legs and of sufficient strength to yieldably resist deformation with respect to the legs when pressed by a user of the device while otherwise holding the frame against the elongation of the at least one resilient resistance member.

13. A universal exercise device comprising:

a rigid frame of a size to be gripped by a user and used for multiple exercises, the rigid framed formed generally in a U-shape with parallel legs of the U-shape having upper portions thereof lying generally in a plane, a bight portion of the U-shape joining the legs at lower portions thereof, the lower portions of the legs bent outwardly of the plane thereof through a relatively wide arc to form generally L-shaped legs having a rocker portion outward of the plane of the upper portions of the legs between the upper portions of the legs and the bight portion, whereby the user can rock on the relatively wide arc, the legs joined together at an upper portion with a U-shaped crosspiece projecting out of the plane of the legs in a direction opposite to the position of the bight portion, and handles formed at an upper portion of the legs for gripping by a user; and at least one resilient resistance member spanning the legs and of sufficient strength to yieldably resist deformation with respect to the legs when pressed by a user of the device while otherwise holding the frame against the elongation of the resilient resistance member.

14. A universal exercise device according to claim 13, wherein the handle is formed by outwardly bent portions of the legs.

15. A universal exercise device comprising:

a rigid frame of a size to be gripped by a user and used for multiple exercises, the rigid frame formed generally in a U-shape with parallel legs of the U-shape having upper portions thereof lying generally in a plane, the legs terminate at upper portions in T-shapes forming handles;

a bight portion of the U-shape joining the legs at lower portions thereof;

the handles formed by outwardly bent portions at an upper portion of the legs for gripping by a user; and at least one resilient resistance member spanning the legs and of sufficient strength to yieldably resist deformation with respect to the legs when pressed by a user of the device while otherwise holding the frame against the elongation of the resilient resistance member.

16. A universal exercise device according to claim 15 wherein, the inwardly directed arms of the T-shapes are joined by a tubular cushion.

17. A universal exercise device according to claim 15, wherein the legs are joined at upper portions with a crosspiece.

18. A universal exercise device according to claim 17, wherein the crosspiece is U-shaped and projects out of the plane of the legs.

19. A universal exercise device according to claim 18, wherein the frame is formed at least in part of tubular members.

20. A universal exercise device according to claim 19 and further comprising at least one tubular cushion mounted to the frame.

21. A universal exercise device according to claim 20, wherein the at least one tubular cushion is mounted on the handle portions of the frame.

22. A universal exercise device according to claim 20, wherein the at least one tubular cushion is mounted to the rocker portions.

23. A universal exercise device according to claim 20, wherein the at least one tubular cushion is mounted to the bight portion.

24. A universal exercise device according to claim 20, wherein the at least one tubular cushion is adhesively secured to the frame.

25. A universal exercise device according to claim 24, wherein the at least one resilient resistant member is slidably mounted to the frame for movement along the legs thereof.

26. A universal exercise device according to claim 25, wherein the at least one resilient resistant member is formed of an elastic band.

27. A universal exercise device according to claim 26, wherein at least one tubular cushion is mounted to the band between the legs.

28. A universal exercise device according to claim 25, wherein three resilient resistant members are mounted to the frame between the legs thereof.

29. A universal exercise device comprising:

a frame portion coupled with a pair of handle portions of a size to be gripped by a user and used for multiple exercises;

the frame portion comprising two spaced, generally L-shaped members defining a pair of parallel planes, a first curved portion of each L-shaped member transitioning uninterruptedly to a cross member extending orthogonal to the parallel planes and rigidly coupling the L-shaped members;

each handle portion coupled at a first end to a second curved portion of the frame portion, and transitioning at a second end to inwardly directed arms forming at least one T-shaped handle extending orthogonal to the parallel planes for gripping by a user; and at least one resilient resistance member spanning at least one of the frame portion and the handle portions, and of sufficient strength to yieldably resist deformation with respect to the at least one of the frame portion and the handle portions when pressed by a user of the exercise device while otherwise holding the exercise device against the elongation of the at least one resilient resistance member.

30. A universal exercise device according to claim 29, wherein the curved portions are bent through a relatively wide arc to form a rocker portion between the handle portions and the cross member, whereby the user can rock on the relatively wide arc.

31. A universal exercise device according to claim 30 wherein the handle portions define a plane and the second ends of the handle portions are joined together with a crosspiece.

32. A universal exercise device according to claim 31 wherein the crosspiece is U-shaped and projects out of the plane defined by the handle portions.

33. A universal exercise device according to claim 32 wherein the crosspiece projects out of the plane defined by the handle portions in a direction opposite to the curved portions of the frame portion.

34. A universal exercise device according to claim 32 wherein the crosspiece projects out of the plane defined by the handle portions on the same side of the plane as the curved portions of the frame portion.

35. A universal exercise device according to claim 29, wherein the frame portion and the handle portions are formed of inner and outer telescoping tubes for adjustment of the length of the exercise device to accommodate users of different heights.

36. A universal exercise device according to claim 29, wherein the inwardly directed arms are joined together.

37. A universal exercise device according to claim 36 wherein the inwardly directed arms are joined together by at least one tubular cushion.

38. A universal exercise device according to claim 29, wherein the inwardly directed arms of the T-shape are joined by a tubular cushion.

39. A universal exercise device according to claim 38 and further comprising at least one tubular cushion mounted to the exercise device.

40. A universal exercise device according to claim 39 wherein the at least one tubular cushion is mounted on the handle portions.

41. A universal exercise device according to claim 39 wherein the at least one tubular cushion is mounted to the rocker portions.

42. A universal exercise device according to claim 39, wherein the at least one tubular cushion is mounted to the curved portion.

43. A universal exercise device according to claim 39, wherein the at least one tubular cushion is adhesively secured to the exercise device.

44. A universal exercise device according to claim 29, wherein the at least one resilient resistant member is slidably mounted to at least one of the frame portion and the handle portions for movement along the at least one of the frame portion and the handle portions thereof.

45. A universal exercise device according to claim 29, wherein the at least one resilient resistant member is formed of an elastic band.

46. A universal exercise device according to claim 45, wherein a tubular cushion is mounted to the band between the handle portions thereof.

* * * * *